US010828216B2

(12) United States Patent
Phalen et al.

(10) Patent No.: US 10,828,216 B2
(45) Date of Patent: Nov. 10, 2020

(54) INFLATABLE PATIENT REPOSITIONING SHEET

(71) Applicant: Medline Industries, Inc., Northfield, IL (US)

(72) Inventors: Drew Phalen, Skokie, IL (US); Vince Hahn, Chicago, IL (US); Jeremy Fogel, Evanston, IL (US)

(73) Assignee: Medline Industries, Inc., Northfield, IL (US)

( * ) Notice: Subject to any disclaimer, the term of this patent is extended or adjusted under 35 U.S.C. 154(b) by 414 days.

(21) Appl. No.: 15/449,560

(22) Filed: Mar. 3, 2017

(65) Prior Publication Data

US 2018/0250180 A1 Sep. 6, 2018

(51) Int. Cl.
*A61G 7/10* (2006.01)

(52) U.S. Cl.
CPC ..... *A61G 7/1021* (2013.01); *A61G 7/1026* (2013.01)

(58) Field of Classification Search
CPC .. A61G 7/1021; A61G 7/1026; A61G 7/1028; A61G 1/01; A61G 1/048; A61G 1/044
USPC ..... 5/81.1 T
See application file for complete search history.

(56) References Cited

U.S. PATENT DOCUMENTS

| | | | | |
|---|---|---|---|---|
| 5,067,189 | A | 11/1991 | Weedling | |
| 5,442,821 | A | 8/1995 | Weeks | |
| RE35,299 | E | 7/1996 | Weedling et al. | |
| 5,561,873 | A * | 10/1996 | Weedling | A61G 7/1028 5/703 |
| 6,073,291 | A * | 6/2000 | Davis | A61B 6/0485 414/676 |
| 6,898,809 | B2 | 5/2005 | Davis | |
| 7,028,350 | B1 | 4/2006 | Davis | |
| 7,107,641 | B2 | 9/2006 | Davis | |
| 7,114,204 | B2 | 10/2006 | Patrick | |
| 7,168,115 | B2 | 1/2007 | Davis | |

(Continued)

FOREIGN PATENT DOCUMENTS

| | | |
|---|---|---|
| EP | 0913138 | 5/1999 |
| WO | 2012103232 | 8/2012 |
| WO | 2012170934 | 12/2012 |

OTHER PUBLICATIONS

PCT Search Report and Written Opinion from International Patent Application No. PCT/US2018/025871 dated Aug. 13, 2018; 12 pages.

(Continued)

*Primary Examiner* — Myles A Throop
(74) *Attorney, Agent, or Firm* — Fitch, Even, Tabin & Flannery LLP

(57) ABSTRACT

Disclosed is an inflatable patient repositioning sheet that includes an inflatable body and a first air supply port and a second air supply port of the inflatable body. The sheet includes a first air delivery sock and a second air delivery sock in the inflatable body. Each air delivery sock has a first end portion and a second end portion, wherein the first end portion of each air delivery sock is in communication with one of the air supply ports and the second end portion is opposite the first end portion. The sheet includes at least one anchor member resisting movement of the second end portion of each air delivery sock toward the first end portion of the air delivery sock in response to air being supplied into the other of the air delivery socks.

23 Claims, 17 Drawing Sheets

(56) References Cited

U.S. PATENT DOCUMENTS 7,210,176 B2 5/2007 Weedling
7,243,382 B2 7/2007 Weedling
7,266,852 B2 9/2007 Davis
7,337,477 B2 3/2008 Scordato
7,373,680 B2 5/2008 Davis
7,376,995 B2 5/2008 Davis
7,406,723 B2 8/2008 Davis
7,415,738 B2 8/2008 Weedling
7,467,431 B2 12/2008 Weedling
7,565,709 B2 7/2009 Davis
7,574,761 B2 8/2009 Davis
7,627,910 B2 12/2009 Davis
7,650,654 B2 1/2010 Lambarth
7,681,262 B2 3/2010 Weedling
7,712,170 B2 5/2010 Davis
7,735,164 B1 6/2010 Patrick
7,739,758 B2 6/2010 Weedling
7,849,533 B1 12/2010 Receveur
7,861,335 B2 1/2011 Deluca
7,900,299 B2 3/2011 Weedling
7,975,330 B2 7/2011 Receveur
8,006,333 B2 8/2011 Genaro
8,201,292 B2 6/2012 Dionne
8,234,727 B2 8/2012 Schreiber
8,276,222 B1 10/2012 Patrick
8,387,177 B2 3/2013 Davis
8,397,326 B2 3/2013 Lafleche
D690,424 S 9/2013 Ponsi
8,566,977 B2 10/2013 Davis
8,656,529 B2 2/2014 Corriveau
8,756,725 B2 6/2014 Piegdon
8,776,290 B2 7/2014 Wilkinson
8,782,826 B2 7/2014 White
8,789,533 B2 7/2014 Steffens
8,832,885 B2 9/2014 Lafleche
8,850,634 B2 10/2014 Ponsi
8,856,992 B2 10/2014 Lafleche
8,887,326 B2 11/2014 Patrick
8,910,325 B2 12/2014 Faucher
8,911,387 B2 12/2014 Lafleche
8,984,681 B2 3/2015 Ponsi
9,101,521 B2 8/2015 White
9,114,050 B2 8/2015 White
9,125,777 B2 9/2015 Patrick
9,132,052 B2 9/2015 Fowler
9,156,656 B2 10/2015 Rosenthal
9,222,498 B2 12/2015 Faucher
9,241,580 B2 1/2016 Patrick
9,278,038 B2 3/2016 Masucci
9,314,388 B2 4/2016 Patrick
9,414,977 B2 8/2016 Ponsi
9,421,140 B2 8/2016 Faucher
9,427,367 B2 8/2016 White
9,456,944 B2 10/2016 Berg
9,693,919 B2 7/2017 Berman
9,693,920 B2 7/2017 Fowler
9,782,312 B2 10/2017 Brubaker
9,820,902 B2 11/2017 Ponsi
9,820,903 B2 11/2017 Steffens
9,820,904 B2 11/2017 Lafleche
9,849,053 B2 12/2017 Rigoni
9,861,544 B2 1/2018 Rigoni
9,877,884 B2 1/2018 Berg
1,003,968 A1 8/2018 Galbraith
1,006,477 A1 9/2018 Rigoni
1,011,780 A1 11/2018 Galbraith
1,018,295 A1 1/2019 Stryker
1,024,499 A1 4/2019 Davis
1,039,861 A1 9/2019 Rigoni
2005/0028273 A1 2/2005 Weedling
2005/0034242 A1* 2/2005 Davis ..... A61G 7/1026 5/711
2005/0076437 A1* 4/2005 Johnson ..... A61G 7/1028 5/81.1 R
2006/0000016 A1* 1/2006 Weedling ..... A61G 7/1028 5/81.1 HS
2006/0021133 A1* 2/2006 Davis ..... A61G 7/1028 5/81.1 R
2006/0282946 A1* 12/2006 Meyer ..... A61G 7/103 5/81.1 HS
2007/0006388 A1 1/2007 Townsend
2007/0266494 A1 11/2007 Deluca
2008/0000028 A1 1/2008 Lemire
2008/0028516 A1 2/2008 Morishima
2008/0120780 A1 5/2008 Genaro
2008/0141463 A1 6/2008 Dionne
2008/0209630 A1 9/2008 Kazala
2008/0263763 A1 10/2008 Butler
2008/0289102 A1* 11/2008 Davis ..... A61G 1/013 5/81.1 R
2010/0229298 A1 9/2010 Davis
2010/0287698 A1 11/2010 Stryker
2011/0056017 A1* 3/2011 Schreiber ..... A61G 7/1026 5/81.1 HS
2011/0072579 A1 3/2011 Receveur
2011/0289691 A1 12/2011 Lafleche
2011/0296623 A1 12/2011 Lafleche
2011/0296624 A1 12/2011 Lafleche
2011/0301516 A1 12/2011 Lafleche
2012/0186012 A1 7/2012 Ponsi
2012/0186013 A1 7/2012 Ponsi
2012/0186587 A1 7/2012 Steffens
2012/0210511 A1 8/2012 Davis
2013/0042414 A1 2/2013 Schreiber
2013/0061396 A1 3/2013 Lafleche
2013/0205495 A1 8/2013 Ponsi
2013/0219628 A1 8/2013 Blanchard
2013/0227787 A1 9/2013 Herbst
2014/0007353 A1 1/2014 Stryker
2014/0041114 A1 2/2014 Davis
2014/0059780 A1 3/2014 Lafleche
2014/0304918 A1 10/2014 Steffens
2015/0000045 A1 1/2015 Lafleche
2015/0047121 A1 2/2015 Berg
2015/0074903 A1 3/2015 Berg
2015/0101126 A1* 4/2015 Reiners ..... A61G 7/1026 5/715
2015/0143628 A1 5/2015 Fowler
2015/0342811 A1 12/2015 Wong
2016/0008194 A1 1/2016 Ponsi
2016/0095777 A1 4/2016 Berman
2016/0331611 A1 11/2016 Ponsi
2016/0367422 A1 12/2016 Weedling
2016/0374883 A1 12/2016 Galbraith
2017/0049646 A1* 2/2017 Rigoni ..... A61G 7/05715
2017/0049647 A1 2/2017 Rigoni
2017/0119608 A1 5/2017 Rigoni
2017/0143565 A1 5/2017 Childs
2017/0151112 A1 6/2017 Fletcher
2017/0172827 A1 6/2017 Schaaf
2017/0216117 A1 8/2017 Rigoni
2017/0296414 A1 10/2017 Fowler
2017/0326011 A1 11/2017 Alvarez
2018/0049935 A1 2/2018 Rigoni
2018/0071158 A1 3/2018 Lafleche
2018/0200130 A1* 7/2018 Liu ..... A61G 7/1021
2018/0303690 A1 10/2018 Hahn
2018/0318162 A1 11/2018 Galbraith
2018/0353360 A1 12/2018 Kea
2018/0369048 A1 12/2018 Rigoni et al.
2018/0369050 A1 12/2018 Davis
2019/0083341 A1 3/2019 Ulreich
2019/0091085 A1 3/2019 Emerson
2019/0091086 A1 3/2019 Emerson
2019/0091088 A1 3/2019 Emerson
2019/0201261 A1 7/2019 Galer
2019/0201262 A1 7/2019 Galer
2019/0216663 A1 7/2019 Ulreich
2019/0231624 A1 8/2019 Lafleche
2019/0380899 A1 12/2019 Rigoni

(56) References Cited

OTHER PUBLICATIONS

Images of Handicare's SystemRoMedic™—SafeHandlingSheet, date unknown.
Image of ArjoHuntleigh's Repositioning Sheet, date unknown.
Images from Prevalon™ AirTAP System™ Demo, product video at https://www.youtube.com/watch?v=BtEaFrElfcU; Sage Products LLC; published on Aug. 9, 2016, 10 pages.
Transcription of and images from Prevalon® Turn & Position System product video at https://www.youtube.com/watch?v=VT82CV1couA; Sage Products LLC published on Dec. 10, 2013, 33 pages.
Transcription of and images from AirPal Air-Assisted Lateral Patient Transfer, product demo at https://www.youtube.com/watch?v=17K5s_9Cr2c; AirPal, Inc.; published on May 1, 2014, 36 pages.
Transcription of and images from Comfort Glide™ Patient Repositioning System, product video at https://vimeo.com/90363103; Medline Industries, Inc.; publicly available at least as of Mar. 2014, 51 pages.
Transcription of and images from HoverMatt® Air Transfer System, product video at https://www.youtube.com/watch?v=8x6XmF5hgyg; CJ Medical; published on Oct. 15, 2014, 7 pages.
PCT Search Report and Written Opinion from International Application No. PCT/US2018/017948 dated Jun. 27, 2018; 15 pages.
Frontier Medical Group, "Automated Patient Turning Repositioned," (2018), 3 pages.

* cited by examiner

INFLATABLE PATIENT REPOSITIONING SHEET

FIELD OF THE DISCLOSURE

This application relates to sheets for repositioning patients and, more specifically, to inflatable patient repositioning sheets.

BACKGROUND

A patient repositioning sheet may be placed under a patient and used to facilitate repositioning a patient, for example, for boosting a patient in a hospital bed. Some patient repositioning sheets may be connectable to an air pump for pumping air into the sheet and inflating the sheet. Some of these inflatable sheets have small openings on a lower side thereof. The openings allow air to exit the sheet and create a partial air bearing between the sheet and the underlying surface, such as a hospital bed. The air bearing reduces frictional resistance to the sheet and the patient thereon from being shifted relative to the supporting surface(s), such as a hospital bed. After use, the inflatable patient transfer sheet may be deflated and removed from under the patient or may be left underneath the patient.

DETAILED DESCRIPTION

Figure 1:
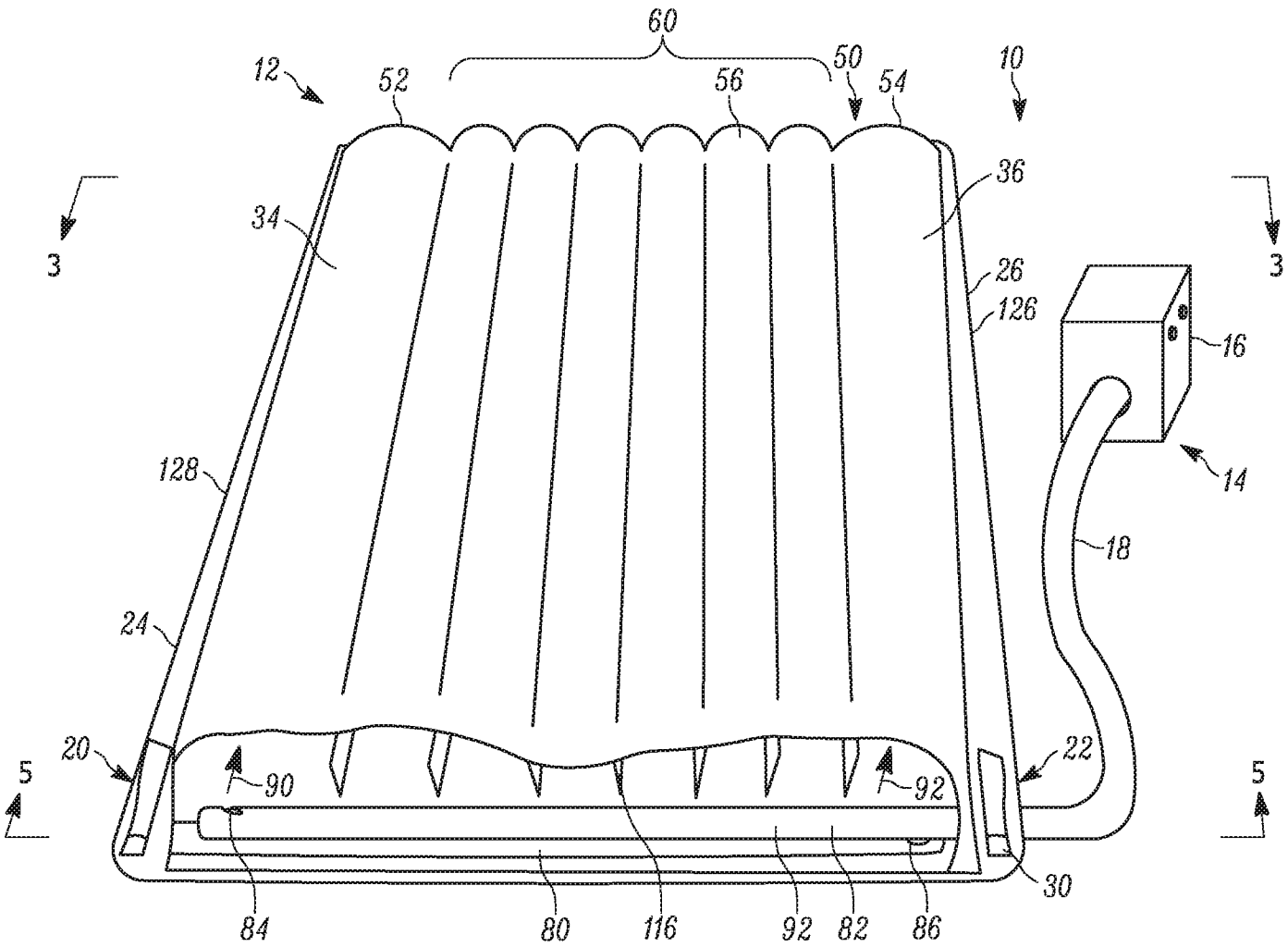
FIG. 1 is a perspective view of an inflatable patient repositioning sheet illustrating a portion of the sheet cut away to show air delivery socks and internal walls of the inflatable sheet.

With reference to FIG. 1, a patient repositioning system 10 is provided the system 10 includes an inflatable patient repositioning sheet 12 and an air supply 14, such as an air pump 16 having a hose 18. The sheet 12 has ports 20, 22 at opposite lateral sides 24, 26 that may each receive the hose 18. The ports 20, 22 each have a closure member, such as a strap 30, which may be manually adjusted constrict the ports 20, 22 about the hose 18 and manipulated to secure the ports 20, 22 about the hose 18. In FIG. 1, the hose 18 is shown secured in the port 22. The air pump 16 may be turned on to provide air through the port 22 and into the sheet 12. In one form, the air pump 16 is capable of providing air at a pressure in the range of approximately five to approximately 20 pounds per square inch to inflate the sheet 12. The air from the air pump 16 inflates the sheet 12 and lifts the patient upward.

The sheet 12 includes an inflatable body 34 having an upper layer 36 with a high friction surface for resisting slipping of the patient relative to the upper layer 36. The inflatable body 34 includes a lower layer 38 having a plurality of air exit holes 40 formed therein. The air within the sheet 12 may exit through the air exit holes 40 (see FIG. 2) and create at least a partial air bearing between an underlying surface 42 and the sheet 12 (see FIG. 4). With the patient transfer sheet 12 inflated, the weight of the patient 31 is distributed over a larger area of the surface 42 than if the patient 31 were lying directly on the surface 42. The air bearing formed by the air exiting through the air exit holes 40 and the distribution of the weight of the patient 31 over a greater surface area reduces frictional resistance to movement of the sheet 12 and patient thereon. In this manner, the sheet 12 and the patient 31 may be easily shifted in a lateral direction 44 (see FIG. 4), such as from the surface 42 onto a nearby surface. The sheet 12 may be used to reposition the patient 31 in many applications, such as boosting, relocating on a surface, and lateral transfers, all of which are generally deemed to constitute repositioning. For example, the inflated patient transfer sheet 12 may be used to transfer the patient 31 from the surface 42 of a hospital bed to a surface of a gurney.

Figure 4:
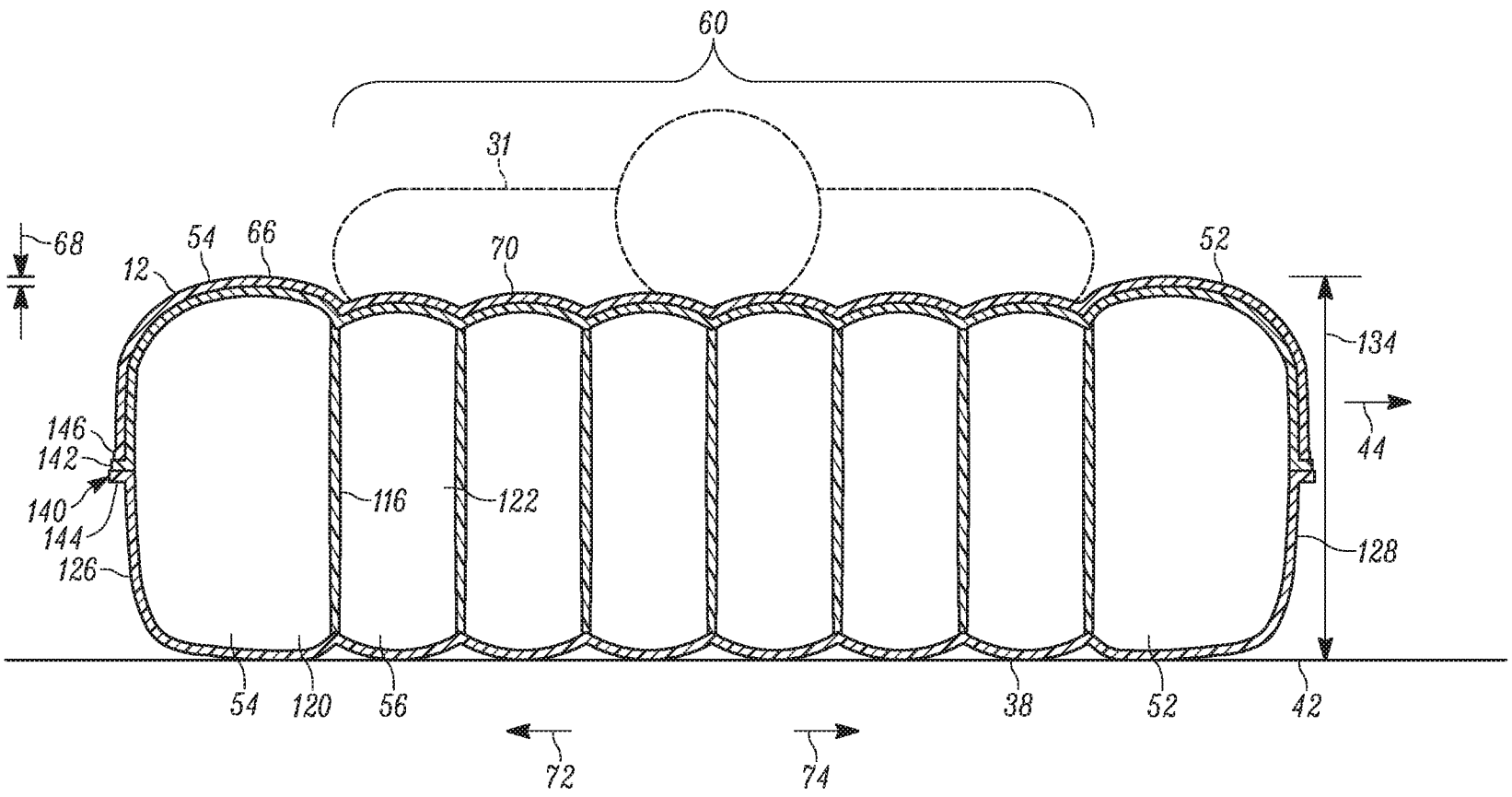
FIG. 4 is a cross-sectional view similar to FIG. 3 showing the sheet in an inflated configuration.

Returning to FIG. 1, the inflatable body 34 includes a plurality of inner channels in the form of tubes 50 that extend longitudinally along the sheet 12, including lateral tubes 52, 54 and central tubes 56. The sheet 12 may have one layer of tubes 50 as shown in FIGS. 1 and 4. In other forms, the sheet 12 may have two or more layers of tubes 50. The tubes 50 may each be formed by portions of the upper and lower layers 36, 38 and baffles or walls 116 extending longitudinally along the sheet 12.

The central tubes 56 may have upper portions 70 that are sized to be smaller than upper portions 66 of the lateral tubes 52 to provide a recessed patient-receiving region 60. With reference to FIG. 4, the patient 31 is positioned in the patient-receiving region 60. The lateral tubes 52, 54 have upper portions 66 that extend for a distance 68 above the upper portions 70 of the central tubes 56. These taller upper portions 66 of the lateral tubes 52, 54 resist lateral movement of the patient 31 in directions 72, 74 out of the patient-receiving region 60.

With reference to FIG. 1, the sheet 12 includes air delivery socks 80, 82 that each receive air from one of the ports 20, 22. When the air hose 18 is coupled to the port 22, the air delivery sock 82 receives air from the hose 18 while the air delivery sock 80 generally does not. Conversely, when the air hose 18 is coupled to the port 22, the air delivery sock 80 receives air from the hose 18 while the air delivery sock 82 generally does not. It is possible in some embodiments for an air supply to be connected to each port simultaneously. The socks 80, 82 have one or more openings 84, 86, such as three openings 84, 86 in each sock 80, 82, which direct air flow generally in directions 90, 92 into the tubes 50. The socks 80, 82 inflate from a flattened, tubular shape to an expanded, tubular shape in response to socks 80, 82 receiving air from the air supply 14. The air from the air supply 14 travels through the socks 80, 82, out the openings 84, 86, and into the tubes 50. In one form, the socks 80, 82 have openings 84, 86 aligned with each of the tubes 50. The socks 80, 82 may have a straight configuration as shown in FIG. 1. In other forms, the socks 80, 82 may have non-linear shapes such as an L-shape.

Figure 2:
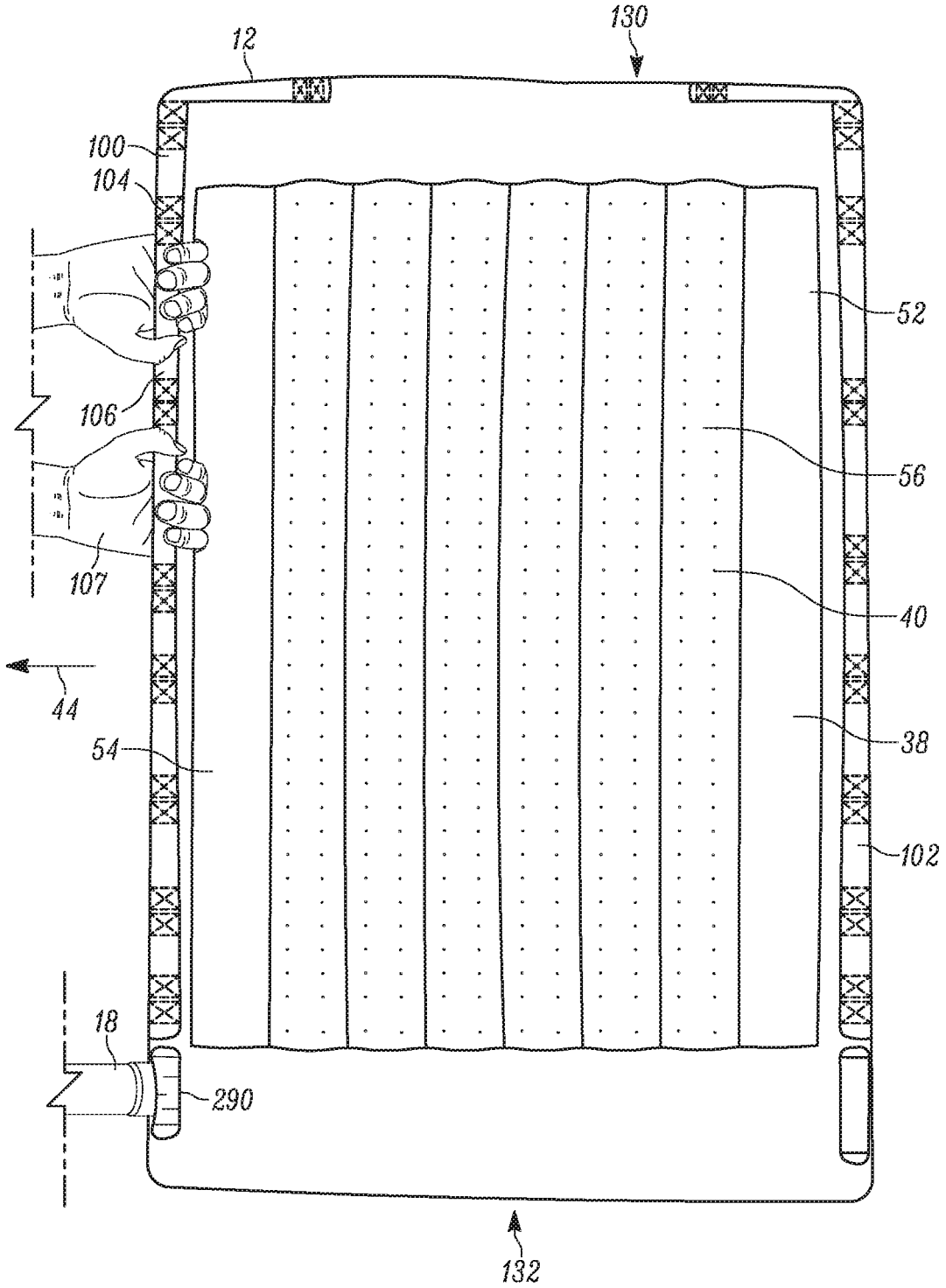
FIG. 2 is a bottom plan view of the sheet of FIG. 1 showing handles on an underside of the sheet.

With reference to FIG. 2, the sheet 12 includes handle straps 100, 102 that are secured, such as by stitches 104, to the lower layer 38. The handles alternately may be stitched to the upper layer 36 or to an edge wall of the sheet 12. The stitches 104 define intermediate handle portions 106 that are spaced from the lower layer 38. In this manner, a person may insert their fingers into the space between the handle portions 106 and the lower layer 38 and wrap his fingers around the handle portion 106 to grasp the handle portion 106. As shown, two hands 107 are grasping two of the handle portions 106 in order to pull the inflated sheet 12 and the patient 31 thereon in the direction 44.

Figure 3:
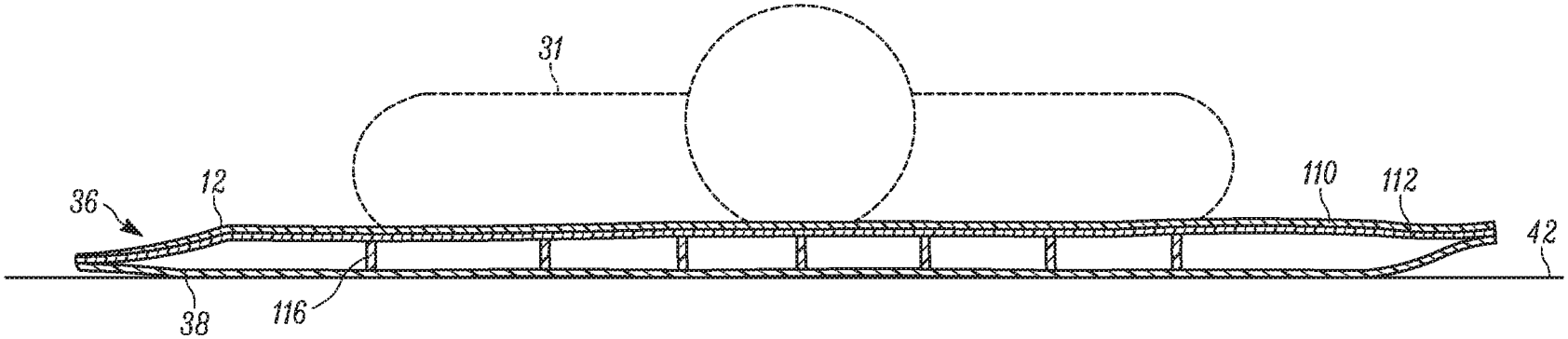
FIG. 3 is a cross-sectional view taken across line 3-3 showing the sheet in a deflated configuration and a patient resting on the sheet.

With reference to FIGS. 3 and 4, the sheet 12 is shown in FIG. 3 in the initial, deflated configuration. The upper layer 36 may include an upper, high friction layer 110, which may include a microfiber fabric. The upper layer 36 may also include a substrate layer 112 that may be include, for example, plastic or nylon. The lower layer 38 may be include, for example, plastic or nylon. It is believed that the lower layer material may have a kinetic friction force ranging from about 10-70 lbf. over a cotton hospital bedsheet, this force being the force required to continue moving a 200 lb. object placed over the material and bedsheet at a constant rate after initiating motion of the object. The upper surface of the high friction layer 110 may create a higher frictional force with the patient than the lower surface of the lower layer 38 creates with the support surface 42. As shown in FIGS. 3 and 4, the walls 116 connect the substrate layer 112 and the lower layer 38. The walls 116 may be joined to the substrate layer 112 and the lower layer 38 by, for example, stitching or adhesive. In one form, the walls 116 are folded when the sheet 12 is in the deflated configuration and are substantially planar when the sheet is in the inflated configuration.

With reference to FIG. 4, the air supply 14 is providing air to the tubes 50 of the sheet 12 which inflates the sheet 12. With the sheet 12 inflated, the walls 116 separate interiors 120, 122 of the tubes 50. As shown in FIG. 4, the sheet 12 includes opposite lateral side walls 126, 128 that extend longitudinally between front and rear walls 130, 132 (see FIG. 2) that extend laterally. The lateral side walls 126, 128 may be longer than the front and rear walls 130, 132. The inflating of the sheet 12 jacks or lifts the patient 31 to an elevated distance 134 above the surface 42.

The substrate layer 112 and the lower layer 38 may be joined together at a seal 140 that connects outer portions 142, 144 thereof. The upper, high friction layer 110 may also be joined at an outer portion 146 thereof to the outer portion 142.

Figure 5:
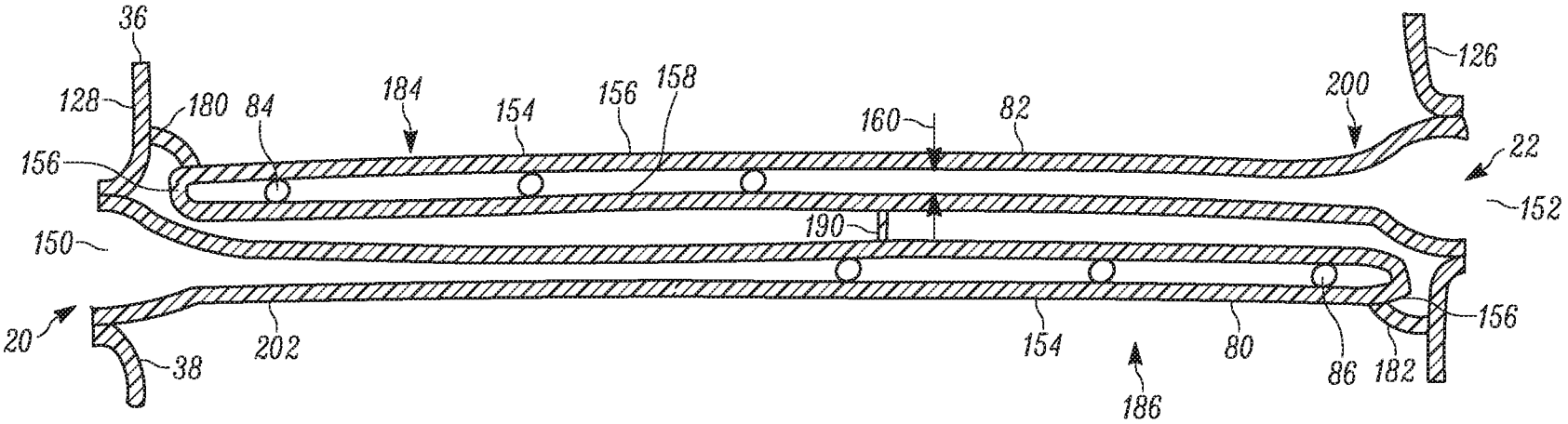
FIG. 5 is a cross-sectional view taken across line 5-5 in FIG. 1 showing the air delivery socks of the sheet in an initial, deflated configuration.

With reference to FIG. 5, the socks 80, 82 of the sheet 12 are shown prior to the hose 18 being inserted to the port 22. The ports 20, 22 include openings 150, 152 sized to receive the hose 18. The socks 80, 82 are shown in a flattened or deflated configuration and each have a generally tubular side wall 154 and an end wall 156. In the deflated configuration, the side wall 154 includes wall portions 156, 158 separated by an initial distance 160.

Figure 6:
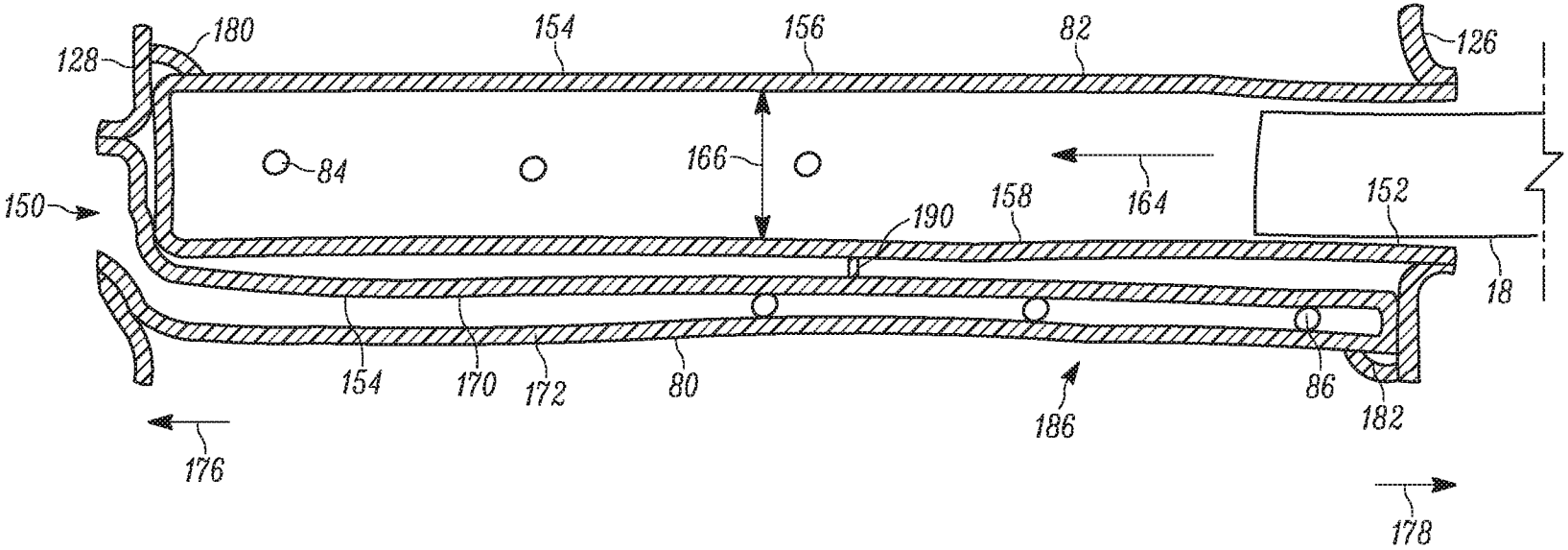
FIG. 6 is a cross-sectional view similar to FIG. 5 showing one of the air delivery socks inflated and compressing the other air delivery sock.

With reference to FIG. 6, the hose 18 has been inserted into the port opening 152 and air is being directed in direction 164 through the sock 82. This expands the sock 82 so that the wall portions 156, 158 of the sidewall 154 now have an expanded distance 166 therebetween. The expansion of the sock 82 in response to receiving the air from the hose 18 causes the side wall 154 of the sock 82 to contact the side wall 154 of the sock 80 and hold side wall portions 170, 172 together. In this manner, the sock 80 is held in the deflated configuration when not in use, which flattens out the openings 86 and makes it difficult for air in the sheet 12 to travel through the openings 86 and out from the port 20. Further, the sock 82 pushes the sock 80 out of the way to resist the sock 80 from inverting, i.e., traveling outward in direction 176 through the opening 150 as air is supplied to the sock 82. Conversely, if the air hose 18 were inserted into opening 150 and used to provide air to the sock 80, the sock 80 would expand and compress the sock 82 and keeps the sock 82 from inverting.

Another feature that keeps the socks 80, 82 from inverting outward in directions 176, 178 through the respective openings 150, 152 is at least one anchor member, such as stitched connectors 180, 182. The connectors 180, 182 connect end portions 184, 186 of the socks 80, 82 to the lateral sidewalls 128, 126. In addition to or instead of the connectors 180, 182, the sheet 12 may have an anchor member, such as a stitched connector 190, connecting the end portions 184, 186. The stitched connector 190 resists the end portions 184, 186 from travelling too far in, respectively, directions 178, 176 and inverting.

With reference to FIG. 5, the socks 80, 82 may have an elongate, generally tubular shape with end portions 200, 202 stitched or otherwise secured to the lateral sidewalls 126, 128. The socks 80, 82 overlap in the lateral direction so that one of the socks 80, 82 may compress the other sock 80, 82 in response to being connected to the air supply 14. Further, the sock 82 may be positioned above the sock 80. In this manner, expansion of the sock 82 causes the sock sidewall portion 156 to contact an interior of the substrate layer 112 and the sidewall portion 158 to press the sock 80 downward against an interior of the lower layer 38.

Figure 7:
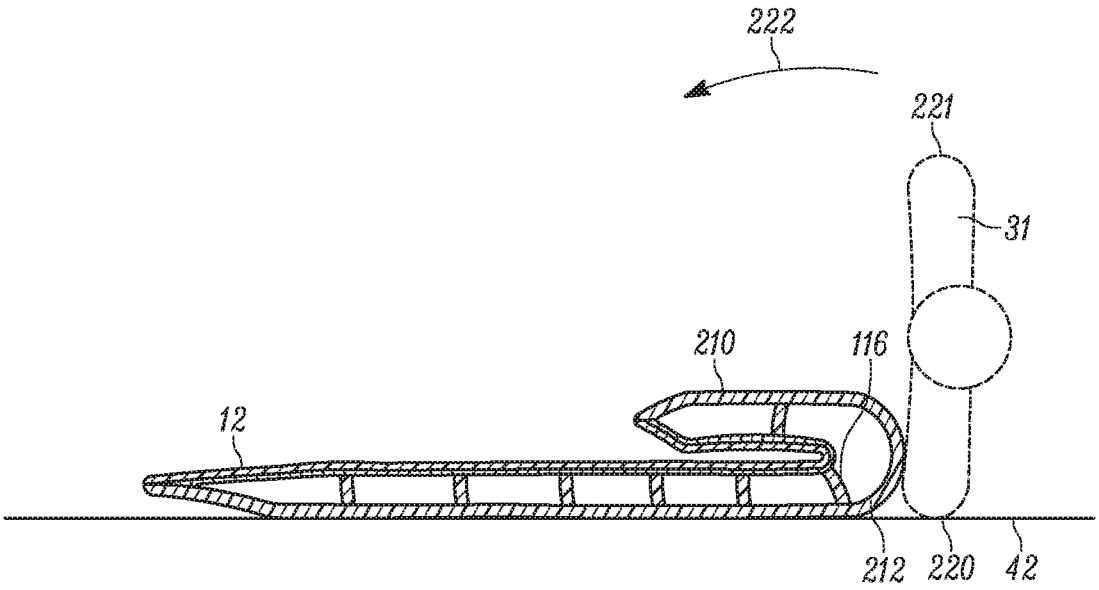
FIG. 7 is a cross-sectional view similar to FIG. 3 showing a patient in a right lateral recumbent and the sheet folded.
Figure 8:
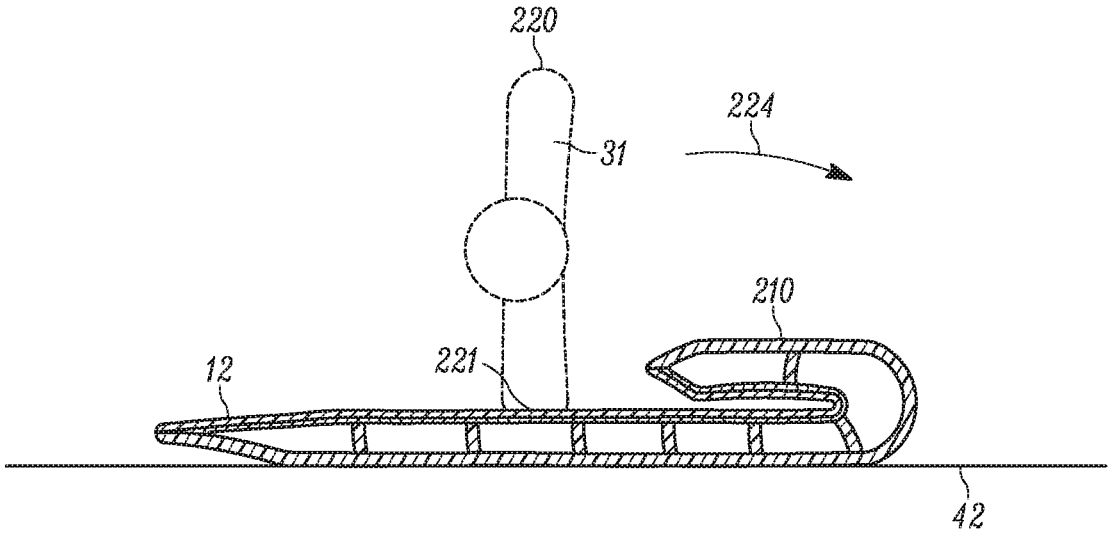
FIG. 8 is a view similar to FIG. 7 showing a patient rolled onto the sheet and positioned in a left lateral recumbent position.
Figure 9:
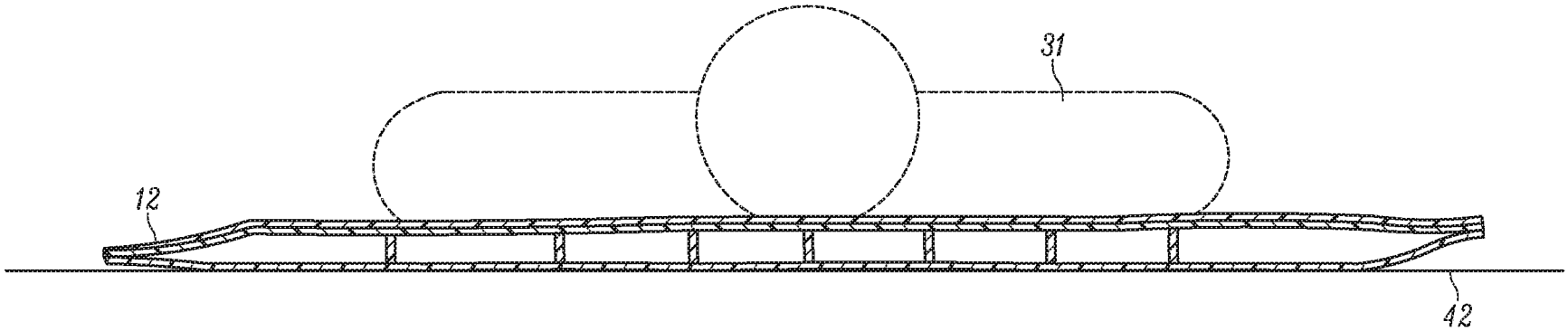
FIG. 9 is a cross-section view similar to FIG. 7 showing the sheet unfolded and the patient turned to a supine position.

A log-rolling approach may be used to position the patient 31 resting on a surface 42 onto the sheet 12. With reference to FIG. 7, initially the sheet 12 is positioned on the support surface 42 with a portion 210 of the sheet 12 folded onto itself. A fold 212 of the sheet 12 is positioned near the back of the patient 31 and the patient is positioned in the recumbent position shown in FIG. 7 with a side 220 of the patient 31 on the surface 42. Next, the patient 31 is rolled in direction 222 over the sheet portion 210 and onto the opposing recumbent position on the sheet 12 as shown in FIG. 8 with the other side 221 of the patient 31 on the sheet 12. The sheet portion 210 is then unfolded in direction 224 onto the support surface 42 and the patient 31 is then rolled in direction 224 to a supine position, as shown in FIGS. 8 and 9. With the patient 31 positioned on their back on the sheet 12, the operator may inflate the sheet 12 using the air supply 14.

Figure 10:
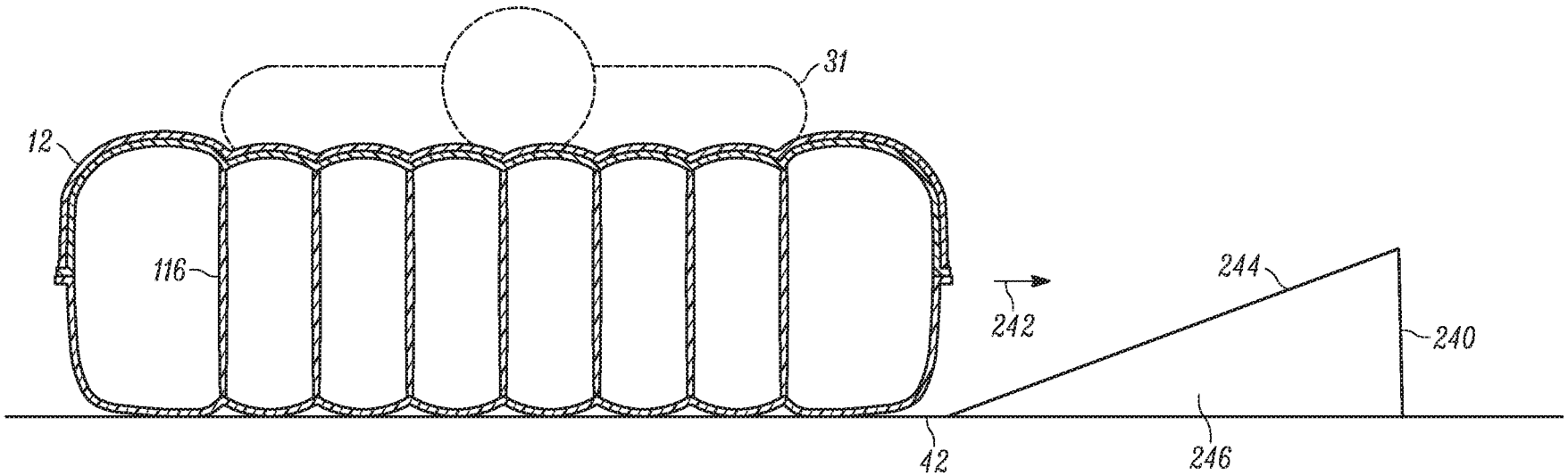
FIG. 10 is a cross-sectional view similar to FIG. 4 showing the patient on the inflated sheet and a wedge.
Figure 11:
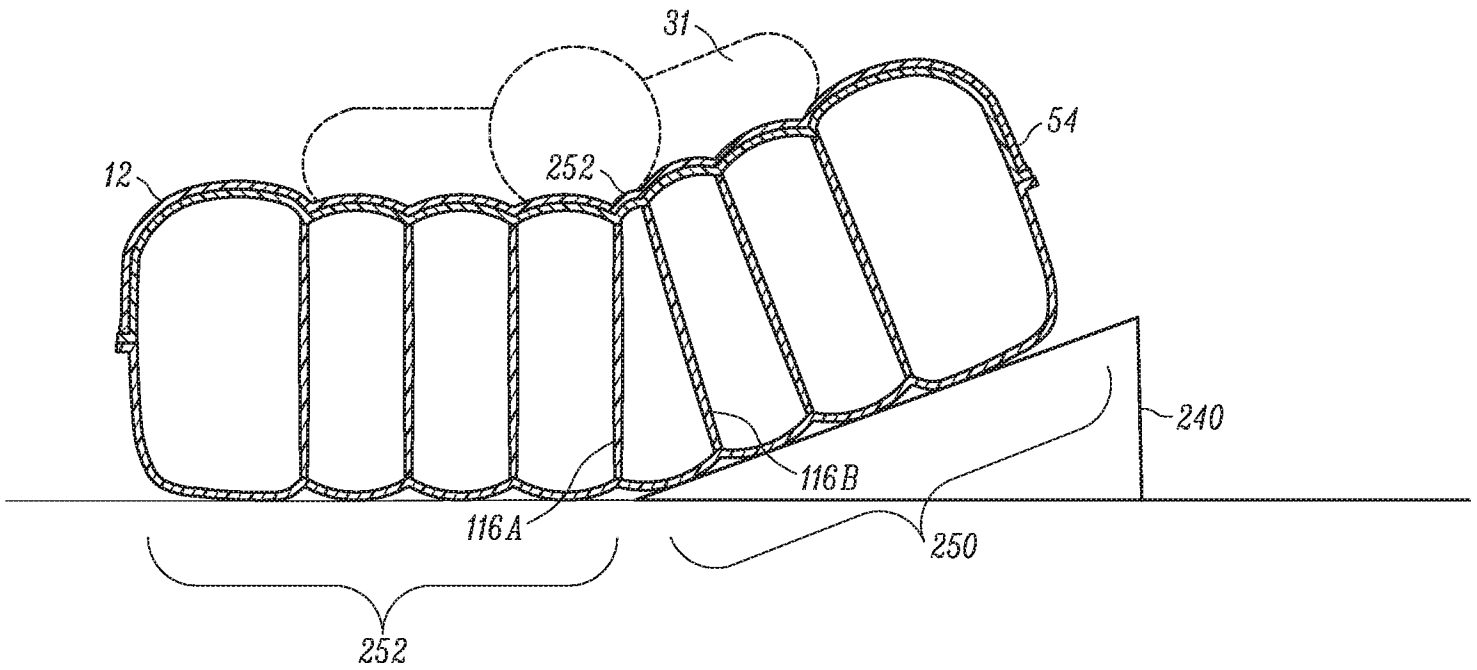
FIG. 11 is a cross-sectional view similar to FIG. 10 showing the sheet shifted on top of the wedge to reposition the patient.

With reference to FIGS. 10 and 11, the sheet 12 may also be used with a wedge 240 to reposition the patient 31. For example, the sheet 12 and the wedge 240 may be used to reposition the patient 31 from a supine position shown in FIG. 10 to a partially recumbent position shown in FIG. 11. The patient should be log-rolled in direction 242 and the wedge placed underneath them. The wedge 240 may have a high friction material on the inclined surface 244 and a base 246 may have a high friction material to resist movement of the wedge 240 along the support surface 42.

In another embodiment, the sheet 12 and the wedge 240 may be used to reposition the patient 31 from a supine position shown in FIG. 10 to a partially recumbent position shown in FIG. 11. The inflated transfer sheet 12 may be shifted in direction 242 up an upper inclined surface 244 of the wedge 240. The wedge 240 may have a low friction material on the inclined surface 244 to permit the sheet 12 to readily slide up the surface 244 and a base 246 and may have a high friction material to resist movement of the wedge 240 along the support surface 42. With reference to FIG. 11, the sheet has been pulled up along the wedge so that a portion 250 of the sheet 12 is inclined relative to another portion 252. As shown in FIG. 11, the shifting of the sheet 12 along the wedge 240 bends the sheet 12 so that walls 116A, 116B extend transversely to one another. This repositioning of the walls 116A, 116B is permitted by bending of a portion 252 of the upper layer 36.

In one approach, the wedge 240 and the sheet 12 may be used to reposition the patient 31 when the sheet 12 is in the deflated state. For example, a portion of the patient 31 may be lifted up using the deflated sheet 12 and one or more wedges 240 may be positioned below the deflated sheet 12. The one or more wedges 240 would then support the patient 31 in the new position. In one form, the upper inclined surface 244 and the base 246 both have high friction material to resist movement of the sheet 12 relative to the wedge 240, and to resist movement of the wedge 240 relative to the surface 42.

Figure 12:
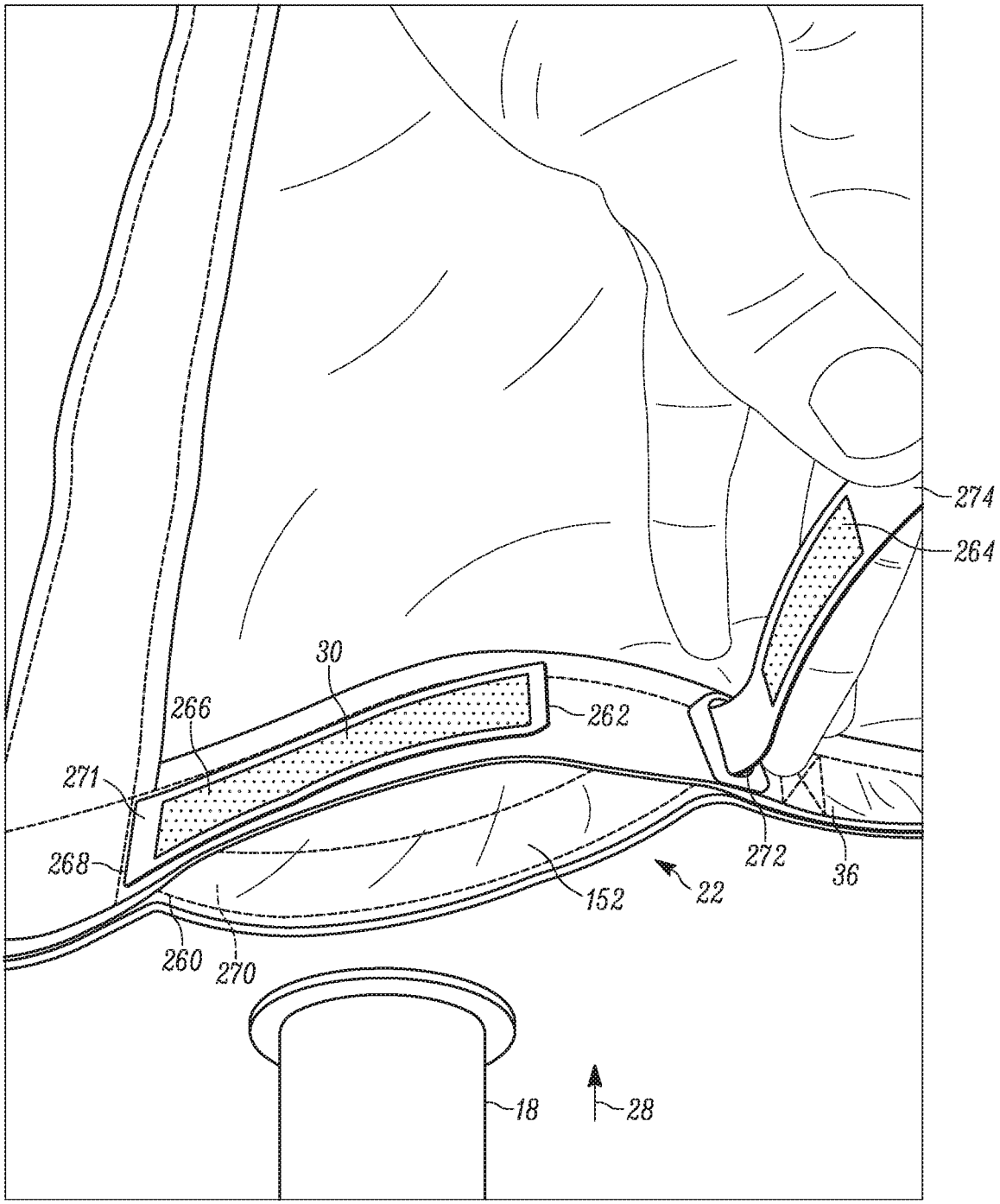
FIG. 12 is a perspective view of a port of the sheet of FIG. 1 with a closure strap in an open configuration.

With reference to FIG. 12, the port 22 will be discussed in detail. The port 20 is substantially identical to the port 22 so that the following description applies to port 20 as well. The port 22 includes the opening 152 sized to receive the air hose 18. The port 22 includes a sleeve 260 extending about the opening 152 that may be constricted about the air hose 18 to resist exit of air through the opening 152 during inflation of the sheet 12. In one form, the sleeve 260 includes portions of the substrate sheet 112 and the lower sheet 38. The strap 30 includes an end 262 secured to the upper sheet 36 such as by stitching. The strap 30 includes securement portions such as a hook and loop fastener arrangement to releasably secure the strap 30 to itself. In one approach, the strap 30 includes loops 264 that releasably engage hooks 266 of the strap 30 when the strap 30 has been moved to a closed position. The strap 30 extends from the end 262, through an opening 268 in the upper sheet 36, and through a portion of the sleeve 260. As shown in FIG. 12, a portion 270 of the strap 30 extends within the sleeve 260. The strap 30 exits the sleeve 260 through an opening 272 of the upper sheet 36. The strap 30 includes a free end 274 that may be grasped and used to manipulate the strap 30. In one form, the strap 30 includes a single substrate 271 and the loops 264 and hooks 266 are secured to the single substrate 271. The single substrate 271 is a single, uninterrupted length of material extending from the end 262 to the end 274. As one example, the single substrate 271 is a strip of woven polymer material and the strap 30 has patches of the loops 264 and hooks 266 sewn onto the strip of material.

Figure 13:
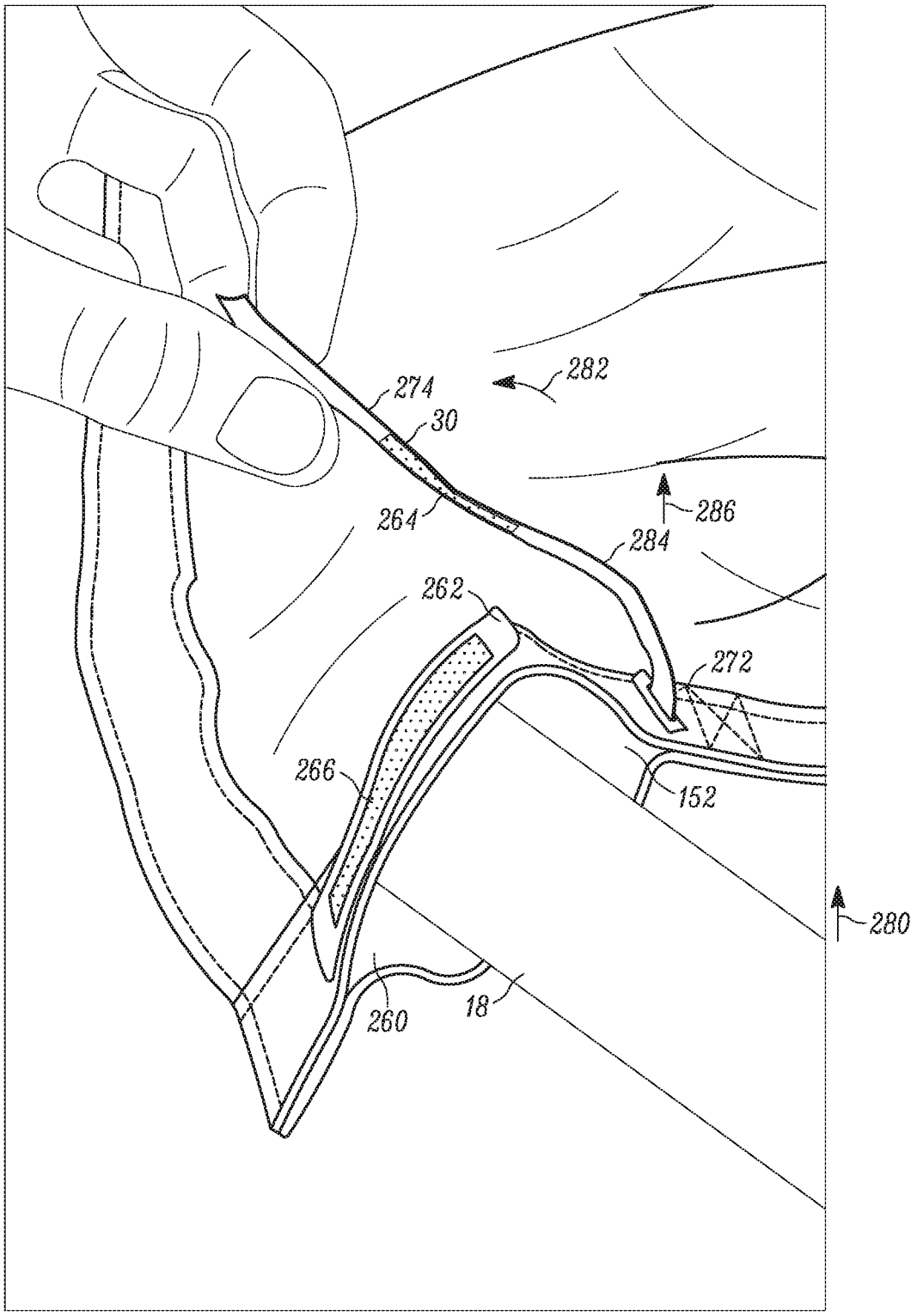
FIG. 13 is a perspective view similar to FIG. 12 showing the closure strap pulled to constrict the port around the air hose.

With reference to FIG. 13, the air hose 18 has been advanced in direction 280 into the opening 152 of the port 22. The end portion 274 of the strap 30 has been pulled over in direction 282 which draws a portion 284 of the strap 30 upward in direction 286 through the opening 272. Because the strap end 262 is secured to the upper sheet 36, drawing the portion 284 outward from the sleeve 260 constricts the sleeve 260 about the air hose 18. With reference to FIG. 2, a lower portion 290 of the sleeve 260 is shown bunched up in response to the strap 30 having been used to constrict the sleeve 260.

Figure 14:
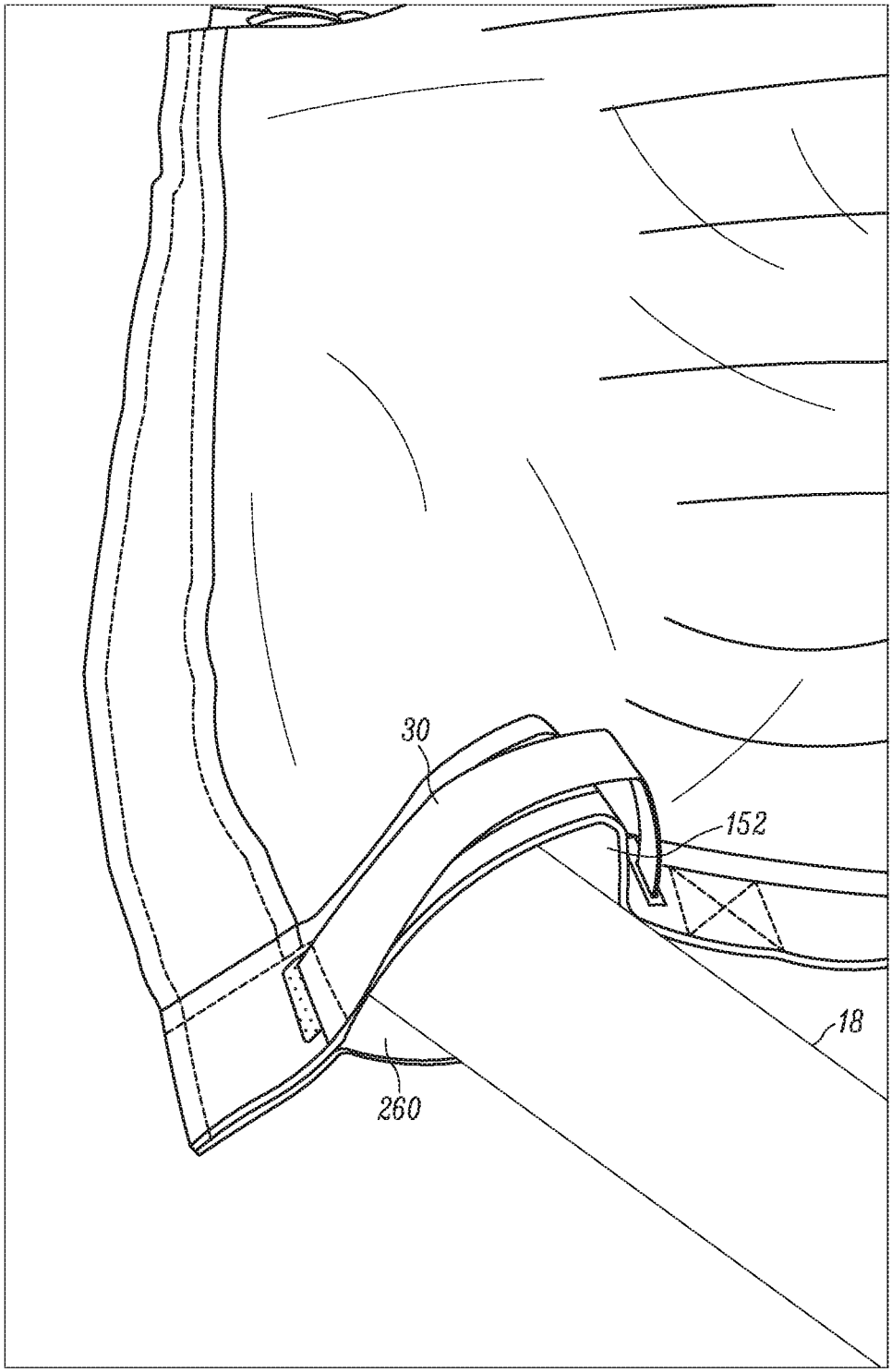
FIG. 14 is a perspective view similar to FIG. 12 showing the closure strap in a closed position which secures the port around the air hose.

With reference to FIG. 14 the strap 30 has been fully pivoted in direction 282 to the closed position to engage the loops 264 and the hooks 266. The engagement between the loops 264 and the hooks 266 maintains the strap 30 in the closed configuration and holds the sleeve 260 in the constricted configuration about the air hose 18 so that the sleeve 260 resists air from exiting the opening 152 around the air hose 18.

Figure 15:
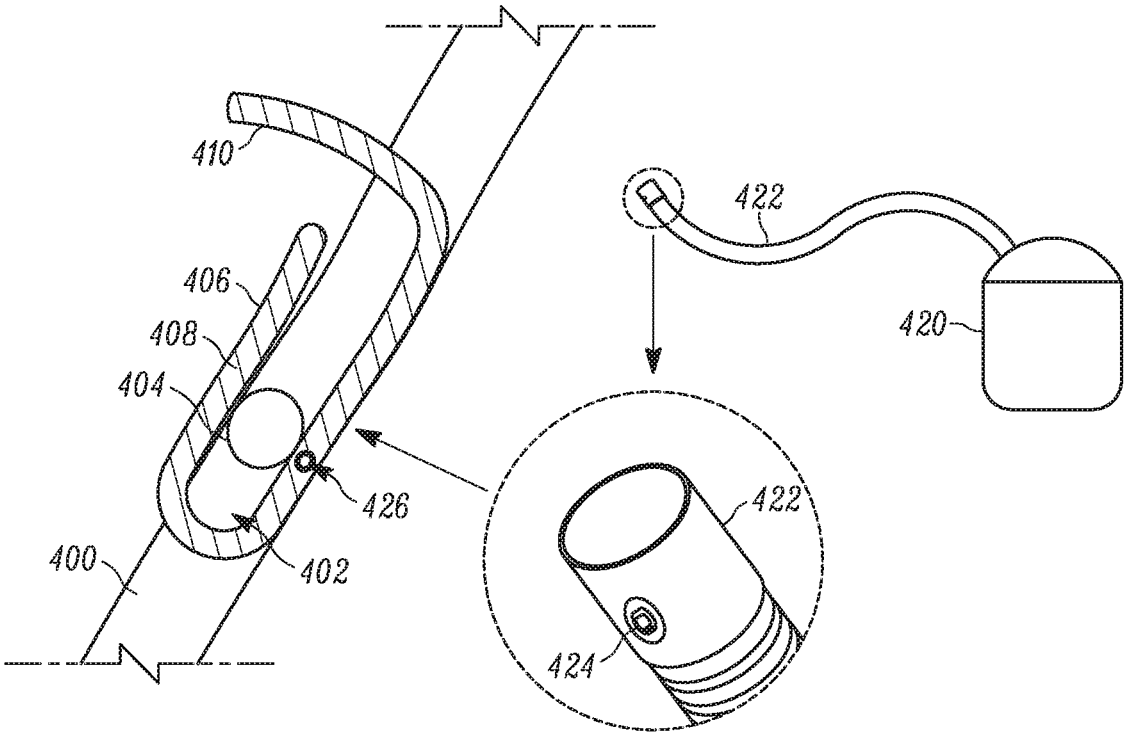
FIG. 15 is a schematic view of a portion of an inflatable patient repositioning sheet and an air supply showing mating snaps of an air hose of the air supply and a closure strap of the sheet.

With reference to FIG. 15, another inflatable patient transfer sheet 400 includes a port 402 having an opening 404 and a strap 406 extending about the opening. The strap 406 includes hooks 408 and loops 410 that may be used to releasably secure the strap 406 in a closed position and constrict the opening 404. In FIG. 15, an air pump 420 is provided that includes an air hose 422. The air hose 422 is sized to fit into the opening 404 of the sheet 400. The inflatable hose 422 includes a pair of snap fastener portions 424 that mate with corresponding snap fastener positions 426 of the strap 406. The mating engagement between the snap fastener portions 424, 426 retains the air hose 422 in the opening 404.

Figure 16:
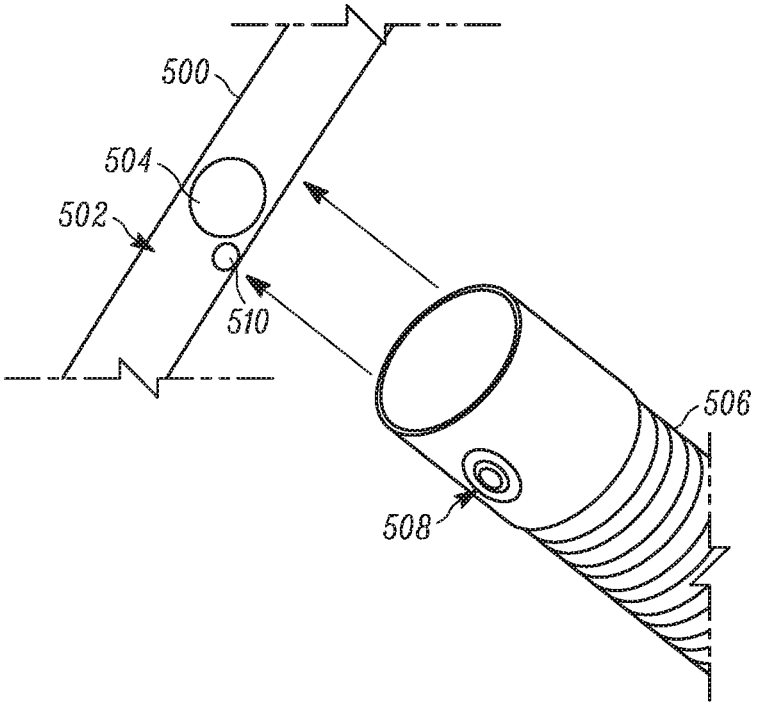
FIG. 16 is a schematic view of a portion of another inflatable patient repositioning sheet and an air hose showing mating snaps of the sheet and the air hose.

With reference to FIG. 16, another inflatable patient transfer sheet 500 includes a port 502 having an opening 504. An air hose 506 is sized to be inserted in the opening 504. The air hose 506 includes snap fastener portions 508 that releasably engage snap fastener portions 510 of the port 502. In the embodiment of FIG. 16, the inflatable sheet 500 does not include a strap for constricting the opening 504.

Figure 17:
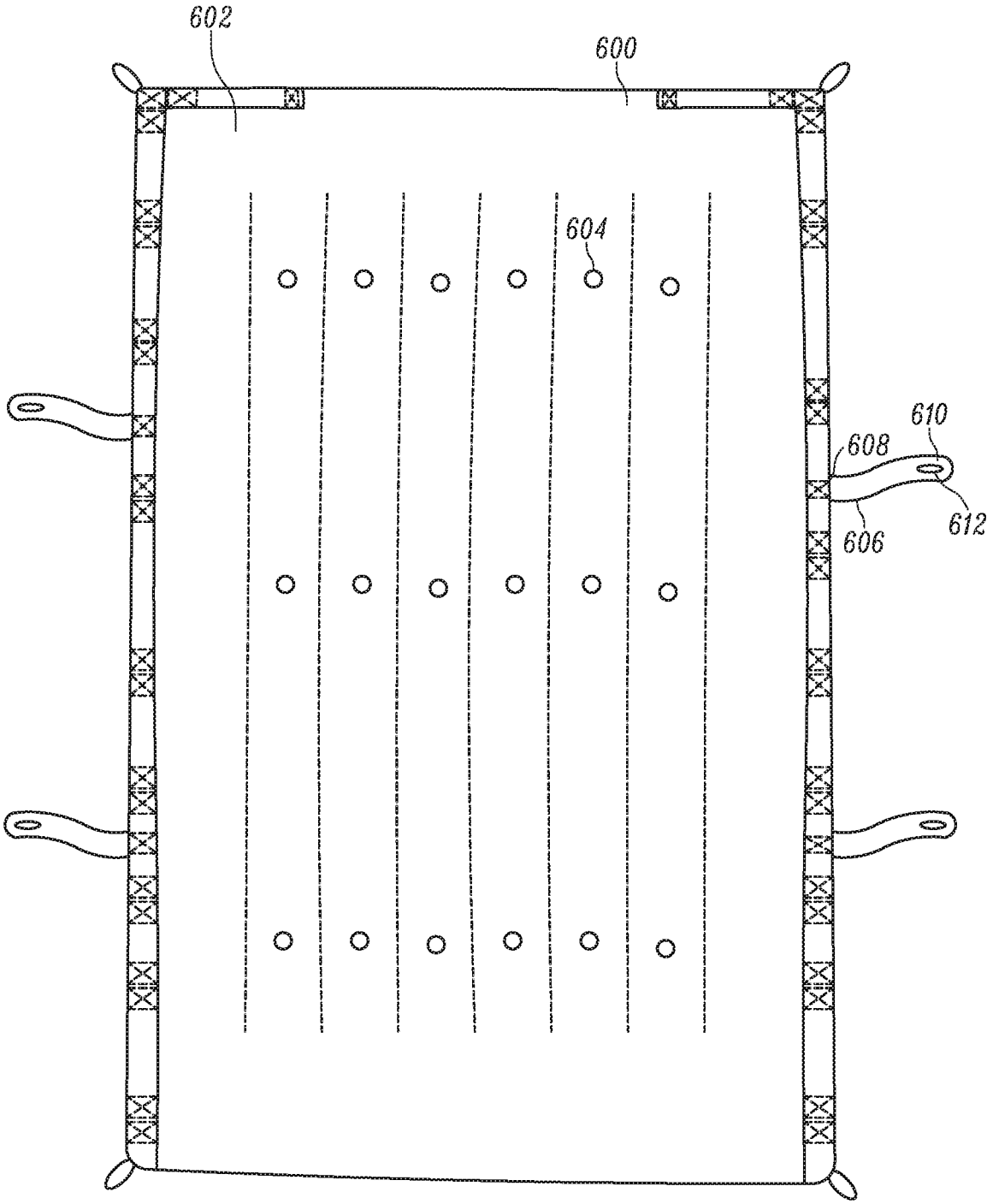
FIG. 17 is a bottom plan view of another inflatable patient repositioning sheet having handles extending laterally outward from the sheet.

With reference to FIG. 17, another inflatable patient transfer sheet 600 includes a lower layer 602 having air exit openings 604. The inflatable patient transfer sheet 600 includes handle straps 606 that are secured to a support 608 of the sheet 600. The handle straps 606 may be of flexible material and include a handle portion 610 with an opening 612.

Figure 18:
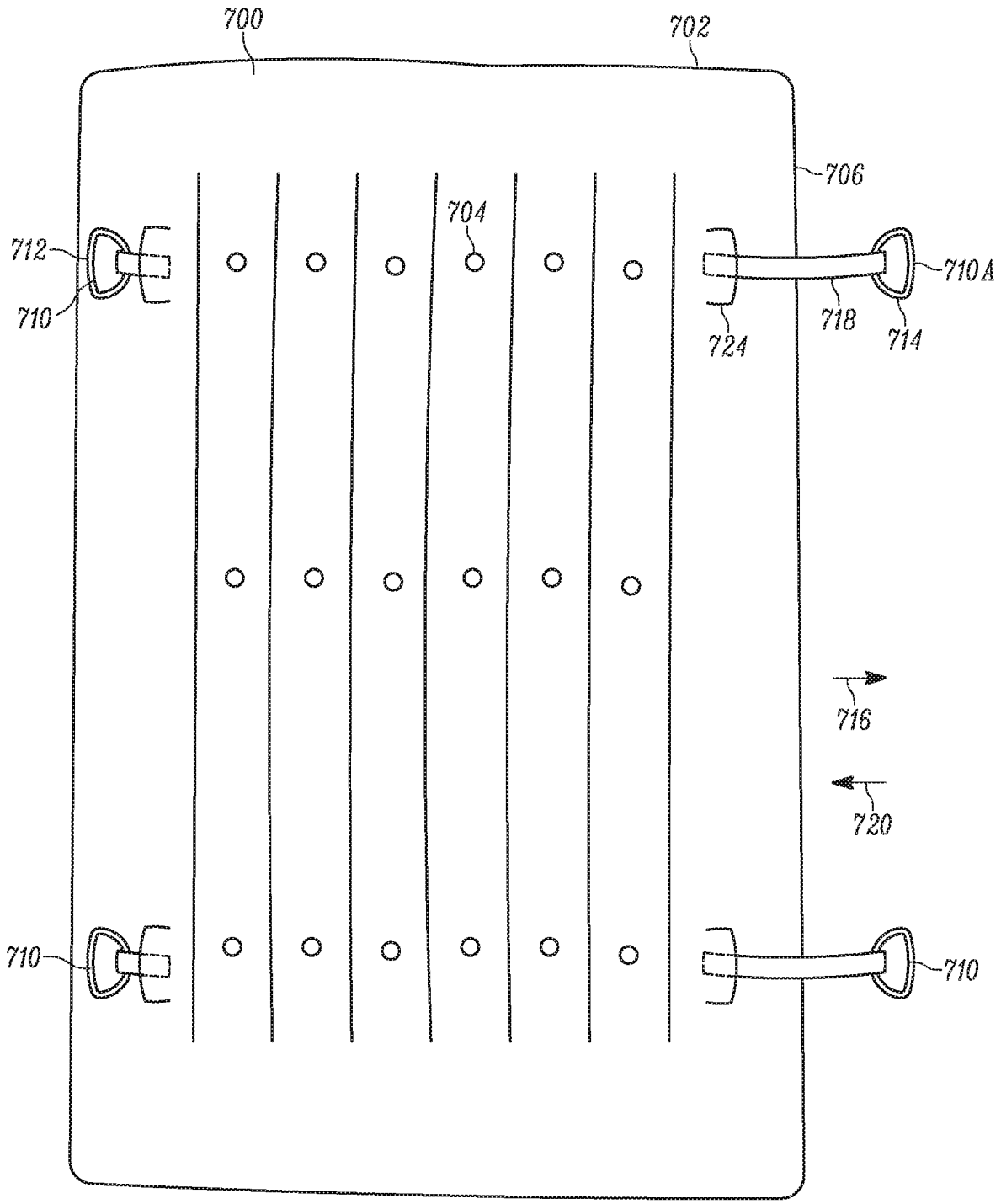
FIG. 18 is a bottom plan view of another inflatable patient repositioning sheet showing handles having storage positions within an outer periphery of the sheet and gripping positions outward from the outer periphery of the sheet.

With reference to FIG. 18, another inflatable patient transfer sheet 700 includes a lower layer 702 with air exit openings 704 and an outer periphery 706. The sheet 700 includes handles 710 (one of which is specifically labeled as 710A) having a storage position 712 within the outer periphery 706 and an operating or gripping position 714 outward from the outer periphery 706. To reposition the handle 710 from the storage position 712 to the gripping position 714, a user may grasp the handle 710 and pull in direction 716. The inflatable patient transfer sheet 700 may include a resilient member, such as an elastic band 718 (shown as elastically extended for handle 710A), which returns the handle 710 in direction 720 after the user releases the handle 710. The elastic band 718 thereby keeps the handle 710 within the outer periphery 706 when not in use. The sheet 700 may include pockets 724 and each elastic band 718 may be anchored to the sheet 700 in an associated pocket 724 so that the elastic band 718 retracts into the pocket 724 when the associated handle 710 is not in use.

Figure 19:
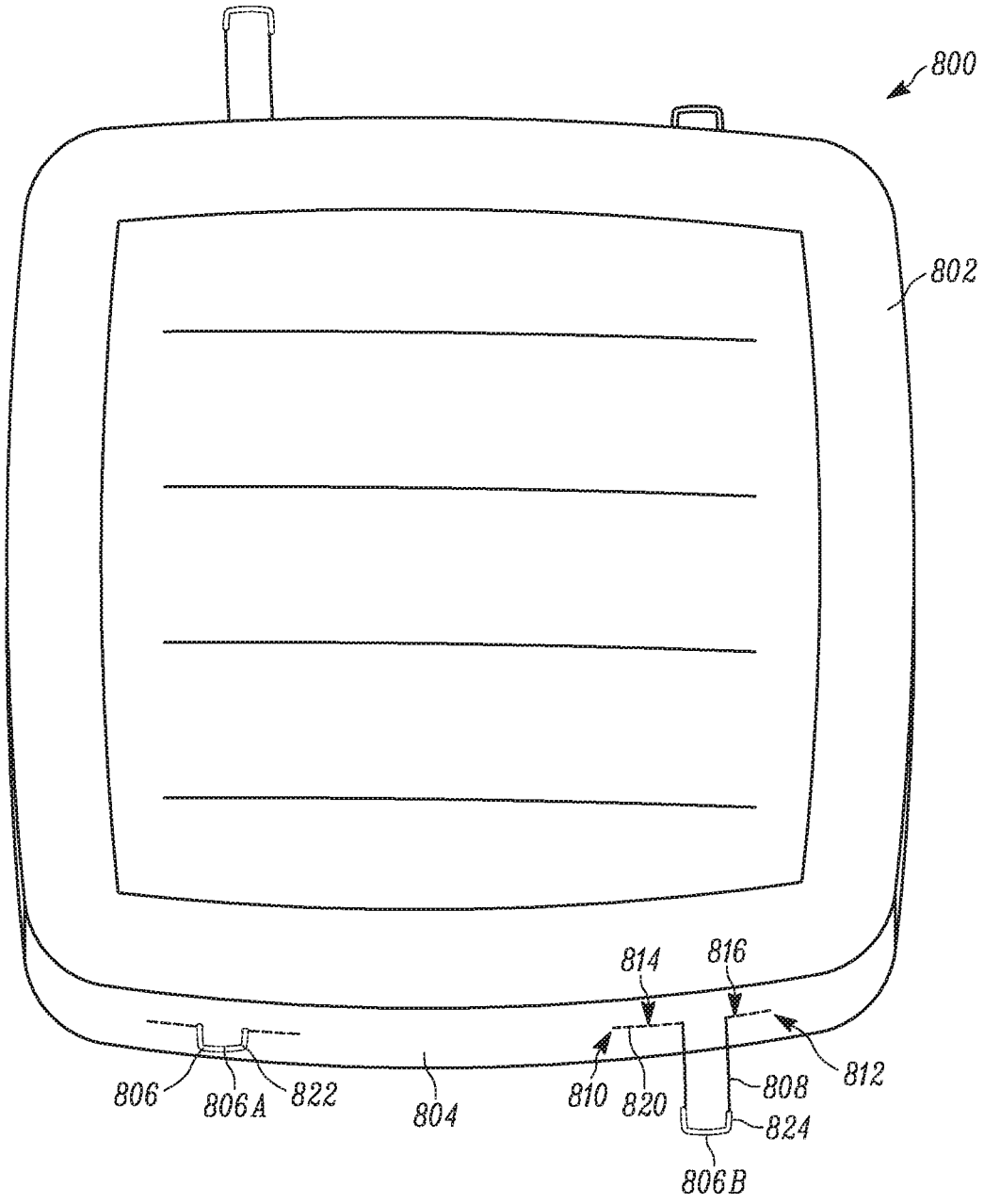
FIG. 19 is a side perspective view of another inflatable patient repositioning sheet showing handles that are movable relative to longitudinal sides of the sheet

With reference to FIG. 19, another inflatable patient transfer sheet 800 includes an inflatable body 802 having longitudinal sides 804 and handles 806 connected to the longitudinal sides 804. The handles 806 are connected to the longitudinal sides 804 by an elastic member 808, such as a strap or nylon string. The elastic member 808 has ends 810, 812 secured to the longitudinal sides 804. Portions 814, 816 of the elastic member 808 may extend within sleeves 820 of the longitudinal sides 804. The handle 806A is shown in a retracted or storage position 822 and the handle 806B is shown in an operating or gripping position 824. By having an extended gripping position 824, a user can move the handle(s) 806 closer to their body so that the user has a better mechanical advantage before using the handle(s) 806 to reposition the sheet 800.

It is thus seen that a patient repositioning sheet is provided.

Uses of singular terms such as "a," "an," are intended to cover both the singular and the plural, unless otherwise indicated herein or clearly contradicted by context. The terms "comprising," "having," "including," and "containing" are to be construed as open-ended terms. Any description of certain embodiments as "preferred" embodiments, and other recitation of embodiments, features, or ranges as being preferred, or suggestion that such are preferred, is not deemed to be limiting. The invention is deemed to encompass embodiments that are presently deemed to be less preferred and that may be described herein as such. All methods described herein can be performed in any suitable order unless otherwise indicated herein or otherwise clearly contradicted by context. The use of any and all examples, or exemplary language (e.g., "such as") provided herein, is intended to illuminate the invention and does not pose a limitation on the scope of the invention. Any statement herein as to the nature or benefits of the invention or of the preferred embodiments is not intended to be limiting. This invention includes all modifications and equivalents of the subject matter recited herein as permitted by applicable law. Moreover, any combination of the above-described elements in all possible variations thereof is encompassed by the invention unless otherwise indicated herein or otherwise clearly contradicted by context. No unclaimed language should be deemed to limit the invention in scope. Any statements or suggestions herein that certain features constitute a component of the claimed invention are not intended to be limiting unless reflected in the appended claims. Neither the marking of the patent number on any product nor the identification of the patent number in connection with any service should be deemed a representation that all embodiments described herein are incorporated into such product or service.

What is claimed is:

1. An inflatable patient repositioning sheet comprising:

an inflatable body including a plurality of longitudinal tubes;

an upper layer of the inflatable body;

a lower layer of the inflatable body joined to the upper layer to define at least a portion of an interior of the inflatable body;

a first air supply port and a second air supply port of the inflatable body;

a first air delivery sock and a second air delivery sock in the inflatable body that are separate and distinct from the upper and lower layers of the inflatable body, each air delivery sock having a first end portion and a second end portion, wherein the first end portion of the first air delivery sock is in communication with the first air supply port and the second end portion of the first air delivery sock is opposite the first end portion thereof, wherein the first end portion of the second air delivery sock is in communication with the second air supply port and the second end portion of the second air delivery sock is opposite the first end portion thereof;

at least one anchor member resisting movement of the second end portion of each air delivery sock toward the first end portion of the air delivery sock in response to air being supplied into the other of the air delivery socks;

wherein the first air delivery sock is elongate and includes a first half and a second half, the first half extending from the first air supply port into the interior of the inflatable body and including the first end portion of the first air delivery sock, the second half of the first air delivery sock including the second end portion of the first air delivery sock and at least one opening;

wherein the first half of the first air delivery sock has an uninterrupted side wall configured to direct air supplied to the first air supply port into the second half of the first air delivery sock and into the interior of the inflatable body via the at least one opening of the second half of the first air delivery sock;

wherein the second air delivery sock is elongate and includes a first half and a second half, the first half extending from the second air supply port into the interior of the inflatable body and including the first end portion of the second air delivery sock, the second half of the second air delivery sock including the second end portion of the second air delivery sock and at least one opening; and wherein the first half of the second air delivery sock has an uninterrupted side wall configured to direct air supplied to the second air supply port into the second half of the second air delivery sock and into the interior of the inflatable body via the at least one opening of the second half of the second air delivery sock.

2. The inflatable patient repositioning sheet of claim 1 wherein the at least one anchor member includes a pair of anchor members securing the second end portions of the air delivery socks to opposite lateral side walls of the inflatable body.

3. The inflatable patient repositioning sheet of claim 1 wherein the at least one anchor member secures the second end portions of the air delivery socks to one another.

4. The inflatable patient repositioning sheet of claim 1 wherein the upper layer includes an upper patient support surface and the lower layer includes a lower sliding surface, wherein one of the air delivery socks is above the other of the air delivery socks.

5. The inflatable patient repositioning sheet of claim 1 wherein the inflatable body includes opposite lateral side walls and the air delivery socks are oriented to extend laterally between the side walls and overlap with one another in the lateral direction.

6. The inflatable patient repositioning sheet of claim 1 wherein the body includes a plurality of longitudinal tubes in communication with the air delivery socks.

7. The inflatable patient repositioning sheet of claim 1 wherein the inflatable body includes a bottom portion having a plurality of through openings that permit air to exit the inflatable body.

8. The inflatable patient repositioning sheet of claim 1 further comprising handles connected to the inflatable body.

9. The inflatable patient repositioning sheet of claim 8 further comprising elastic members connecting the handles to the inflatable body.

10. The inflatable patient repositioning sheet of claim 1 wherein the air supply ports each include an opening sized to receive an air supply hose and a flexible closure member permitting constriction of the opening about the air supply hose, the closure member having a first end secured to the inflatable body and a second end opposite the first end; and a pair of securement portions of the closure member adapted to be releasably engaged together to hold the closure member in a looped configuration about the air supply hose.

11. A system including the inflatable patient repositioning sheet of claim 1 and an air supply, the air supply including a hose and an air pump, the hose sized to extend through one of the air supply ports of the inflatable body.

12. A method comprising:

providing the inflatable patient repositioning sheet of claim 1; and positioning a patient on the inflatable patient repositioning sheet.

13. The method of claim 12 further comprising:

connecting an air supply to one of the air supply ports; and inflating the inflatable patient repositioning sheet.

14. An inflatable patient repositioning sheet comprising:

an elongate, inflatable body having opposite lateral sides extending longitudinally, the inflatable body including a contiguous array of longitudinal tubes, the contiguous array of longitudinal tubes including a first side longitudinal tube at a first lateral side of the inflatable body and a second side longitudinal tube at the second lateral side of the inflatable body, the contiguous array of longitudinal tubes including at least two central longitudinal tubes side-by-side and intermediate the side longitudinal tubes;

a first air supply port and a second air supply port of the inflatable body, the first air supply port at the first lateral side of the inflatable body and the second air supply port at the second lateral side of the inflatable body;

a first air delivery sock extending laterally into the inflatable body from the first air supply port and a second air delivery sock extending laterally into the inflatable body from the second air supply port;

the first and second air delivery socks extending in proximity to one another in the inflatable body, the air delivery socks being in communication with the air supply ports of the body and the plurality of longitudinal tubes;

each air delivery sock being adapted to inflate in response to the air delivery sock receiving air from an air supply and press against the other air delivery sock;

wherein the first air delivery sock routes the air introduced into the first air supply port laterally beyond the first side longitudinal tube and into at least one first longitudinal tube of the longitudinal tubes of the contiguous array via at least one first opening of the first air delivery sock longitudinally aligned with the at least one first longitudinal tube; and wherein the second air delivery sock routes the air introduced into the second air supply port laterally beyond the second side longitudinal tube and into at least one second longitudinal tube of the longitudinal tubes of the contiguous array via at least one second opening of the second air delivery sock longitudinally aligned with the at least one second longitudinal tube.

15. The inflatable patient repositioning sheet of claim 14 wherein the inflatable body includes an upper patient support surface and a lower sliding surface and one of the air delivery socks is above the other air delivery sock in the inflatable body.

16. The inflatable patient repositioning sheet of claim 14 wherein the air delivery socks are anchored to each other or to the inflatable body so that each air delivery sock resists inverting in response to the other air delivery sock receiving air from an air supply.

17. The inflatable patient repositioning sheet of claim 14 wherein the air delivery socks extend in a lateral direction intermediate the lateral side walls with at least a portion of the air delivery socks overlapping in the lateral direction.

18. The inflatable patient repositioning sheet of claim 14 further comprising handles connected to the inflatable body.

19. The inflatable patient repositioning sheet of claim 14 further comprising elastic members connecting the handles to the inflatable body.

20. The inflatable patient repositioning sheet of claim 14 wherein the air supply ports each include an opening sized to receive an air supply hose and a flexible closure member permitting constriction of the opening about the air supply hose, the closure member having a first end secured to the inflatable body and a second end opposite the first end; and a pair of securement portions of the closure member adapted to be releasably engaged together to hold the closure member in a looped configuration about the air supply hose.

21. A system including the inflatable patient repositioning sheet of claim 14 and an air supply, the air supply including a hose and an air pump, the hose sized to extend through one of the air supply ports of the inflatable body.

22. A method comprising:

providing the inflatable patient repositioning sheet of claim 14; and positioning a patient on the inflatable patient repositioning sheet.

23. The method of claim 22 further comprising:

connecting an air supply to one of the air delivery socks; and inflating the inflatable patient repositioning sheet.

* * * * *